US011131492B2

(12) United States Patent
Scalf

(10) Patent No.: US 11,131,492 B2
(45) Date of Patent: Sep. 28, 2021

(54) DUAL DIRECTION REFRIGERATOR ICE MAKER

(71) Applicant: Midea Group Co., Ltd., Foshan (CN)

(72) Inventor: Eric Scalf, Louisville, KY (US)

(73) Assignee: MIDEA GROUP CO., LTD., Foshan (CN)

( * ) Notice: Subject to any disclaimer, the term of this patent is extended or adjusted under 35 U.S.C. 154(b) by 71 days.

(21) Appl. No.: 16/711,094

(22) Filed: Dec. 11, 2019

(65) Prior Publication Data

US 2021/0180848 A1 Jun. 17, 2021

(51) Int. Cl.

| | |
|---|---|
| ***F25C 1/10*** | (2006.01) |
| ***F25D 11/02*** | (2006.01) |
| ***F25C 1/24*** | (2018.01) |
| ***F25C 5/182*** | (2018.01) |
| ***F25C 5/20*** | (2018.01) |
| ***F25C 1/25*** | (2018.01) |

(52) U.S. Cl.

CPC ..... *F25C 1/10* (2013.01); *F25C 1/24* (2013.01); *F25C 1/25* (2018.01); *F25C 5/182* (2013.01); *F25C 5/22* (2018.01); *F25D 11/02* (2013.01); *F25C 2305/022* (2013.01); *F25C 2400/06* (2013.01); *F25C 2600/02* (2013.01)

(58) Field of Classification Search

CPC ..... F25C 1/10; F25C 1/25; F25C 5/22; F25C 1/24; F25C 5/182; F25C 2305/002; F25C 2400/06; F25C 2600/02; F25D 2323/021; F25D 11/02

See application file for complete search history.

(56) References Cited

U.S. PATENT DOCUMENTS

| | | | | |
|---|---|---|---|---|
| 2,968,168 | A | 1/1961 | Lippincott | |
| 4,838,026 | A | 6/1989 | Seari | |
| 5,212,955 | A | 5/1993 | Hogan | |
| 7,051,541 | B2 | 5/2006 | Chung et al. | |
| 7,216,491 | B2 | 5/2007 | Cole et al. | |
| 7,891,208 | B2 | 2/2011 | Kim et al. | |
| 8,499,572 | B2 | 8/2013 | Lim et al. | |
| 8,528,351 | B2 | 9/2013 | An et al. | |
| 9,803,908 | B2 | 10/2017 | Amo | |
| 10,267,551 | B2 | 4/2019 | Ji et al. | |
| 10,415,866 | B2 | 9/2019 | Brabenec et al. | |
| 2006/0016207 | A1* | 1/2006 | Tremblay | F25C 1/20 62/342 |
| 2006/0201170 | A1 | 9/2006 | Cole | |
| 2008/0250796 | A1 | 10/2008 | Clugston et al. | |
| 2009/0249804 | A1 | 10/2009 | Davis et al. | |
| 2010/0229574 | A1* | 9/2010 | An | F25C 5/08 62/73 |

(Continued)

FOREIGN PATENT DOCUMENTS

| | | | |
|---|---|---|---|
| KR | 101236771 | B1 * | 2/2013 |
| WO | WO2010060787 | A | 6/2010 |

OTHER PUBLICATIONS

KR-101236771-B1 translation.*

(Continued)

*Primary Examiner* — Elizabeth J Martin
(74) *Attorney, Agent, or Firm* — Middleton Reutlinger

(57) ABSTRACT

A refrigerator utilizes a dual direction ice maker capable of overlapping multiple ice production cycles in time to accelerate ice production and/or routing ice to multiple storage bins.

22 Claims, 11 Drawing Sheets

(56) References Cited

U.S. PATENT DOCUMENTS

| | | | | |
|---|---|---|---|---|
| 2012/0291473 | A1 | 11/2012 | Krause et al. | |
| 2016/0040919 | A1 | 2/2016 | Go et al. | |
| 2017/0003061 | A1 | 1/2017 | Lee | |
| 2017/0089629 | A1 | 3/2017 | Ji et al. | |
| 2019/0041112 | A1 | 2/2019 | Chatelle et al. | |
| 2019/0086134 | A1 | 3/2019 | Lee et al. | |
| 2019/0178552 | A1* | 6/2019 | Scalf | F25C 5/22 |

OTHER PUBLICATIONS

Appliance Repair. Refrigerator Repair & Icemaker Repair. Chapter 8 Domestic Icemakers. Retrieved from: https://www.appliancerepair.net.refrigerator-repair-8.html. Retrieved on Oct. 17, 2019.

International Search Report and Written Opinion issued in PCT Application No. PCT/CN2020/096854, dated Sep. 17, 2020.

* cited by examiner

DUAL DIRECTION REFRIGERATOR ICE MAKER

BACKGROUND

Residential refrigerators generally include both fresh food compartments and freezer compartments, with the former maintained at a temperature above freezing to store fresh foods and liquids, and the latter maintained at a temperature below freezing for longer-term storage of frozen foods. Various refrigerator designs have been used, including, for example, top mount refrigerators, which include a freezer compartment near the top of the refrigerator, either accessible via a separate external door from the external door for the fresh food compartment, or accessible via an internal door within the fresh food compartment; side-by-side refrigerators, which orient the freezer and fresh food compartments next to one another and extending generally along most of the height of the refrigerator; and bottom mount refrigerators, which orient the freezer compartment below the fresh food compartment and including sliding and/or hinged doors to provide access to the freezer and fresh food compartments.

Irrespective of the refrigerator design employed, many refrigerator designs also include an ice dispensing system having an externally-accessible dispenser that is disposed at a convenient height on the front of the refrigerator, most often on the surface of one of the doors that provide access to one of the refrigerator compartments. The ice dispensing system also generally includes an ice maker capable of producing ice and depositing the produced ice into a storage bin for later on-demand dispensing by a consumer.

Some ice maker designs used in refrigerators include a stationary and upwardly-facing mold in which ice cubes are formed and a rotatable ejector that is used to eject the ice cubes from the mold once they are formed. Some ice maker designs also include a heater that is activated prior to ejection of the ice cubes in order to release the ice cubes from the mold, which results in a layer of water on the outer surfaces of the ice cubes. As such, in many of these designs an additional structure adjacent to the mold may be used to temporarily support the ice cubes once they are ejected from the molds in order to enable the water on the surfaces of the ice cubes to refreeze prior to dropping the ice cubes into a storage bin, as otherwise the ice cubes could freeze together while resting in the storage bin.

One limitation of conventional stationary mold ice maker designs is that the time between ice production cycles can be relatively long. Production of one batch of ice generally cannot be started until production of a prior batch of ice is complete due to the fact that the same mold is used to produce each batch of ice. As a result, if a consumer completely empties the storage bin, e.g., when filling an ice cooler, it can take an appreciable amount of time to refill the storage bin. Therefore, a continuing need exists in the art for a manner of accelerating the production of ice by a refrigerator ice maker.

In addition, some conventional ice dispensing systems utilize multiple storage bins, e.g., to increase overall ice storage capacity. Conveying ice from an ice maker to multiple storage bins, however, can be complex and require dedicated doors or other mechanisms to properly route ice to the different storage bins. Therefore, another continuing need exists in the art for a simple and effective manner of conveying ice to different storage bins.

SUMMARY

The herein-described embodiments address these and other problems associated with the art by providing a dual direction ice maker capable of overlapping multiple ice production cycles in time to accelerate ice production and/or routing ice to multiple storage bins.

Therefore, consistent with one aspect of the invention, a refrigerator ice maker may include a mold including a plurality of mold cavities, first and second drying surfaces disposed on opposite sides of the mold, and a rotatable ejector configured to eject ice cubes formed in the plurality of mold cavities onto either of the first and second drying surfaces.

In some embodiments, the mold is upwardly-facing and stationary. Also, in some embodiments, the rotatable ejector includes a plurality of fingers extending generally transverse to an axis of rotation of the rotatable ejector and configured to sweep through the plurality of mold cavities, and at least one of the first and second drying surfaces includes a plurality of slots configured to allow passage of the plurality of fingers through the at least one of the first and second drying surfaces. Further, in some embodiments, the rotatable ejector is bidirectional and is configured to rotate in a first direction to eject ice cubes onto the first drying surface and rotate in a second direction to eject ice cubes onto the second drying surface.

In some embodiments, the rotatable ejector is configured to rotate in a first direction to eject a first set of ice cubes formed in the plurality of mold cavities onto the first drying surface while the first set of ice cubes are only partially frozen, and the refrigerator ice maker is configured to cause the mold to be filled with water prior to full freezing of the first set of ice cubes to initiate formation of a second set of ice cubes in the mold while the first set of ice cubes are disposed on the first drying surface.

In addition, in some embodiments, the rotatable ejector is configured to rotate and push the first set of ice cubes off of the first drying surface after the mold is filled with water. In some embodiments, the rotatable ejector is configured to rotate and push the first set of ice cubes off of the first drying surface by rotating in a second direction that pushes ice cubes from the second set of ice cubes into contact with ice cubes from the first set of ice cubes. In addition, in some embodiments, the rotatable ejector is configured to rotate in the second direction after the first set of ice cubes are pushed off the first drying surface to eject the second set of ice cubes onto the second drying surface.

In addition, some embodiments may further include first and second cube diverting surfaces positioned generally above an axis of rotation of the rotatable ejector and intermediate the first and second drying surfaces and respectively configured to divert ice cubes formed in the plurality of mold cavities toward the first and second drying surfaces. In some embodiments, first and second storage receptacles are respectively positioned below the first and second drying surfaces such that ice cubes pushed from the first and second drying surfaces respectively drop into the first and second storage receptacles. Some embodiments may also include a heater coupled to the mold and configured to heat the mold to release the ice cubes in connection with ejecting the ice cubes with the rotatable ejector.

Consistent with another aspect of the invention, a refrigerator ice maker may include a mold including a plurality of mold cavities, a drying surface disposed adjacent the mold, and a rotatable ejector configured to eject ice cubes formed in the plurality of mold cavities onto the drying surface, the rotatable ejector further configured to push the ice cubes from the drying surface after the mold is filled with water.

Moreover, in some embodiments, the rotatable ejector is bidirectional and is configured to rotate in a first direction to eject the ice cubes onto the drying surface and rotate in a second direction to the push the ice cubes from the drying surface after the mold is filled with water. In some embodiments, the ice cubes include a first set of ice cubes, the rotatable ejector is configured to rotate in a first direction to eject the first set of ice cubes formed in the plurality of mold cavities onto the drying surface while the first set of ice cubes are only partially frozen, and the refrigerator ice maker is configured to cause the mold to be filled with water prior to full freezing of the first set of ice cubes to initiate formation of a second set of ice cubes in the mold while the first set of ice cubes are disposed on the drying surface.

In addition, in some embodiments, the rotatable ejector is configured to rotate and push the first set of ice cubes off of the first drying surface by rotating in a second direction that pushes ice cubes from the second set of ice cubes into contact with ice cubes from the first set of ice cubes. In some embodiments, the drying surface is a first drying surface, the refrigerator ice maker further includes a second drying surface extending along an opposite side of the mold from the first drying surface, and the rotatable ejector is configured to rotate in the second direction after the first set of ice cubes are pushed off the first drying surface to eject the second set of ice cubes onto the second drying surface.

Moreover, in some embodiments, first and second storage receptacles are respectively positioned below the first and second drying surfaces such that ice cubes pushed from the first and second drying surfaces respectively drop into the first and second storage receptacles. In addition, some embodiments may further include a cube diverting surface positioned generally above an axis of rotation of the rotatable ejector and configured to divert ice cubes formed in the plurality of mold cavities toward the drying surface.

In some embodiments, the cube diverting surface is a first cube diverting surface and the drying surface is a first drying surface, and the refrigerator ice maker further includes a second drying surface extending along an opposite side of the mold from the first drying surface, and a second cube diverting surface positioned generally above the axis of rotation of the rotatable ejector and configured to divert ice cubes formed in the plurality of mold cavities toward the second drying surface.

Consistent with another aspect of the invention, a refrigerator ice maker may include a mold including a plurality of mold cavities, a drying surface disposed adjacent the mold, and a rotatable ejector configured to eject a first set of ice cubes formed in the plurality of mold cavities onto the drying surface, the rotatable ejector further configured to push the first set of ice cubes from the drying surface by ejecting a second set of ice cubes subsequently formed in the plurality of mold cavities such that the second set of ice cubes pushes the first set of ice cubes from the drying surface.

Consistent with another aspect of the invention, a refrigerator may include a cabinet including one or more food compartments and one or more doors closing the one or more food compartments, and an ice system disposed in the cabinet. The ice system includes an ice maker including a mold including a plurality of mold cavities and a rotatable ejector configured to eject ice cubes formed in the plurality of mold cavities, and first and second storage receptacles respectively disposed below first and second sides of the mold, where the rotatable ejector of the ice maker is configured to rotate in a first direction to eject the ice cubes for dispensing into the first storage receptacle and to rotate in a second direction to eject the ice cubes for dispensing into the second storage receptacle.

In addition, in some embodiments, the one or more food compartments includes a freezer compartment and a fresh food compartment disposed in the cabinet above the freezer compartment and having a top wall, a bottom wall, and first and second side walls, the bottom wall separating the fresh food compartment from the freezer compartment. The refrigerator further includes a console extending upwardly from the bottom wall of the fresh food compartment only a portion of a height of the fresh food compartment and spaced apart from each of the top wall, the first side wall, and the second side wall, the console including one or more walls that insulate an interior compartment of the console from the fresh food compartment, and where the ice maker and the first storage receptacle are disposed in the console.

Consistent with another aspect of the invention, a method of making ice may include forming an ice cube in a mold of a refrigerator ice maker, ejecting the ice cube from the mold and onto a drying surface of the refrigerator ice maker, filling the mold with water after ejecting the ice cube, and pushing the ice cube off of the drying surface after filling the mold with water.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
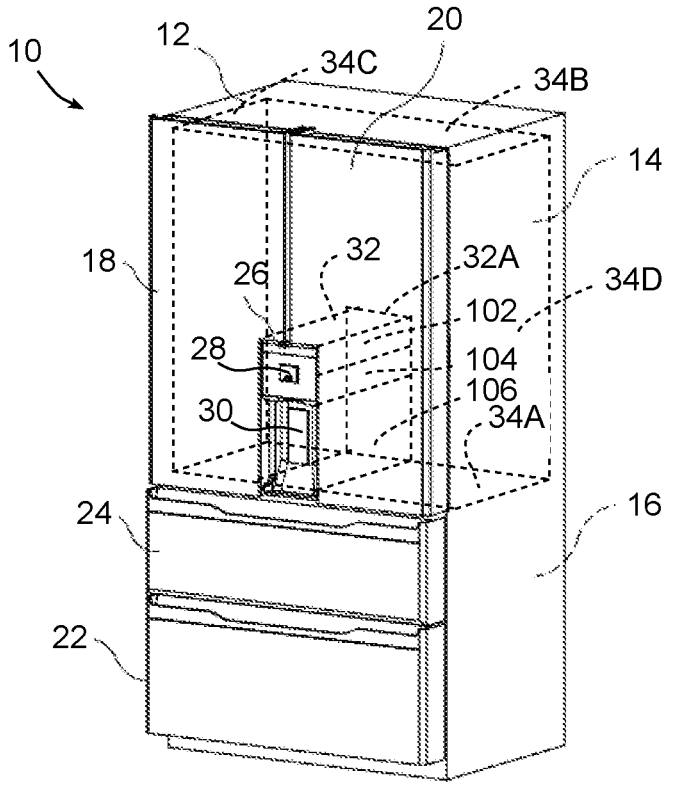
FIG. 1 is a perspective view of an example implementation of a refrigerator consistent with some embodiments of the invention.

Turning now to the drawings, wherein like numbers denote like parts throughout the several views, FIG. 1 illustrates an example refrigerator 10 in which the various technologies and techniques described herein may be implemented. Refrigerator 10 is a residential-type refrigerator, and as such includes a cabinet or case 12 including one or more food storage compartments (e.g., a fresh food compartment 14 and a freezer compartment 16), as well as one or more fresh food compartment doors 18, 20 and one or more freezer compartment doors 22, 24 disposed adjacent respective openings of food storage compartments 14, 16 and configured to insulate the respective food storage compartments 14, 16 from an exterior environment when the doors are closed.

Fresh food compartment 14 is generally maintained at a temperature above freezing for storing fresh food such as produce, drinks, eggs, condiments, lunchmeat, cheese, etc. Various shelves, drawers, and/or sub-compartments may be provided within fresh food compartment 14 for organizing foods, and it will be appreciated that some refrigerator designs may incorporate multiple fresh food compartments and/or zones that are maintained at different temperatures and/or at different humidity levels to optimize environmental conditions for different types of foods. Freezer compartment 16 is generally maintained at a temperature below freezing for longer-term storage of frozen foods, and may also include various shelves, drawers, and/or sub-compartments for organizing foods therein.

Refrigerator 10 as illustrated in FIG. 1 is a type of bottom mount refrigerator commonly referred to as a French door refrigerator, fresh food compartment doors 18, 20 are side-by-side fresh food compartment doors that are hinged along the left and right sides of the refrigerator to provide a wide opening for accessing the fresh food compartment. Freezer compartment doors 22, 24 are sliding freezer compartment doors that are similar to drawers and that pull out to provide access to items in the freezer compartment. Both the fresh food compartment and the freezer compartment may be considered to be full width as they extend substantially across the full width of the cabinet 12. It will be appreciated, however, that other door designs may be used in other embodiments, including various combinations and numbers of hinged and/or sliding doors for each of the fresh food and freezer compartments (e.g., a pair of French freezer doors, a single sliding freezer door, or one hinged fresh food and/or freezer door). Moreover, while refrigerator 10 is a bottom mount refrigerator with freezer compartment 16 disposed below fresh food compartment 14, the invention is not so limited, and as such, the principles and techniques may be used in connection with other types of refrigerators in other embodiments, e.g., top mount refrigerators, side-by-side refrigerators, etc.

Refrigerator 10 also includes a cabinet-mounted dispenser 26 for dispensing ice and/or water. Dispenser 26 may include one or more external user controls and/or displays, including, for example, a water dispenser control 28 and an ice dispenser control 30. In the illustrated embodiments, dispenser 26 is an ice and water dispenser capable of dispensing both ice and chilled water, while in other embodiments, dispenser 26 may be an ice only dispenser for dispensing only cubed and/or crushed ice. In still other embodiments, dispenser 26 may additionally dispense hot water, sparkling water, coffee, beverages, or other liquids, and may have variable and/or fast dispense capabilities. In some instances, ice and water may be dispensed from the same location, while in other instances separate locations may be provided in the dispenser for dispensing ice and water. In addition, while dispenser 26 is illustrated as being mounted on the cabinet 12, and thus separate from any door, in other embodiments dispenser 26 may be door-mounted, and as such, may be disposed on a fresh food or freezer door. In still other embodiments, dispenser 26 may be disposed within a compartment of a refrigerator, and accessible only after opening a door. Further, in some embodiments, no ice dispenser and/or no water dispenser may be used, as in some refrigerator designs, an ice maker may be disposed internally within a refrigerator and accessible only after opening an external door of the refrigerator.

Figure 2:
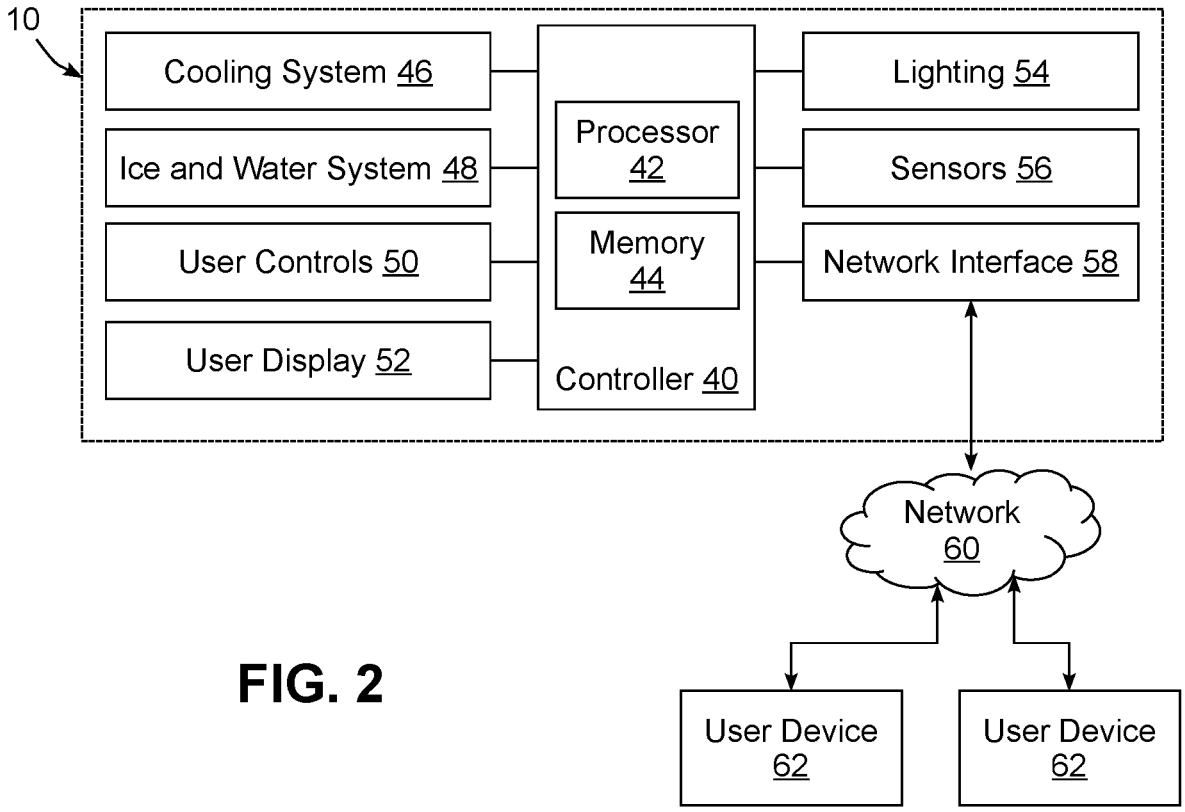
FIG. 2 is a block diagram of an example control system for the refrigerator of FIG. 1.

A refrigerator consistent with the invention also generally includes one or more controllers configured to control a refrigeration system as well as manage interaction with a user. FIG. 2, for example, illustrates an example embodiment of a refrigerator 10 including a controller 40 that receives inputs from a number of components and drives a number of components in response thereto. Controller 40 may, for example, include one or more processors 42 and a memory 44 within which may be stored program code for execution by the one or more processors. The memory may be embedded in controller 40, but may also be considered to include volatile and/or non-volatile memories, cache memories, flash memories, programmable read-only memories, read-only memories, etc., as well as memory storage physically located elsewhere from controller 40, e.g., in a mass storage device or on a remote computer interfaced with controller 40.

As shown in FIG. 2, controller 40 may be interfaced with various components, including a cooling or refrigeration system 46, an ice and water system 48, one or more user controls 50 for receiving user input (e.g., various combinations of switches, knobs, buttons, sliders, touchscreens or touch-sensitive displays, microphones or audio input devices, image capture devices, etc.), and one or more user displays 52 (including various indicators, graphical displays, textual displays, speakers, etc.), as well as various additional components suitable for use in a refrigerator, e.g., interior and/or exterior lighting 54, among others. User controls and/or user displays 50, 52 may be disposed, for example, on one or more control panels disposed in the interior and/or on doors and/or other external surfaces of the refrigerator. Further, in some embodiments audio feedback may be provided to a user via one or more speakers, and in some embodiments, user input may be received via a spoken or gesture-based interface. Additional user controls may also be provided elsewhere on refrigerator 10, e.g., within fresh food and/or freezer compartments 14, 16. In addition, refrigerator 10 may be controllable remotely, e.g., via a smartphone, tablet, personal digital assistant or other networked computing device, e.g., using a web interface or a dedicated app.

Controller 40 may also be interfaced with various sensors 56 located to sense environmental conditions inside of and/or external to refrigerator 10, e.g., one or more temperature sensors, humidity sensors, etc. Such sensors may be internal or external to refrigerator 10, and may be coupled wirelessly to controller 40 in some embodiments. Sensors 56 may also include additional types of sensors such as door switches, switches that sense when a portion of an ice dispenser has been removed, and other status sensors, as will become more apparent below.

In some embodiments, controller 40 may also be coupled to one or more network interfaces 58, e.g., for interfacing with external devices via wired and/or wireless networks such as Ethernet, Wi-Fi, Bluetooth, NFC, cellular and other suitable networks, collectively represented in FIG. 2 at 60. Network 60 may incorporate in some embodiments a home automation network, and various communication protocols may be supported, including various types of home automation communication protocols. In other embodiments, other wireless protocols, e.g., Wi-Fi or Bluetooth, may be used.

In some embodiments, refrigerator 10 may be interfaced with one or more user devices 62 over network 60, e.g., computers, tablets, smart phones, wearable devices, etc., and through which refrigerator 10 may be controlled and/or refrigerator 10 may provide user feedback.

In some embodiments, controller 40 may operate under the control of an operating system and may execute or otherwise rely upon various computer software applications, components, programs, objects, modules, data structures, etc. In addition, controller 40 may also incorporate hardware logic to implement some or all of the functionality disclosed herein. Further, in some embodiments, the sequences of operations performed by controller 40 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the refrigerator illustrated in FIGS. 1-2 will be apparent to one of ordinary skill in the art, as will become apparent from the description below. Therefore, the invention is not limited to the specific implementations discussed herein.

Dual Direction Ice Maker

In some embodiments discussed hereinafter, a refrigerator may include a dual direction ice maker suitable for improving ice production in a number of different manners in different embodiments. As will become more apparent below, for example, in some embodiments, a dual direction ice maker may be used to overlap multiple ice production cycles in time to accelerate overall ice production rates. Further, in some embodiments, in lieu of or in addition to accelerating overall ice production rates, a dual direction ice maker may be used to simplify routing of ice to multiple storage bins disposed in a refrigerator. It will be appreciated that control over an ice maker to implement the various techniques disclosed herein may be managed by one or more controllers of the refrigerator, by one or more separate controllers dedicated to the ice and water system or ice maker, or by a combination thereof.

Figure 3:
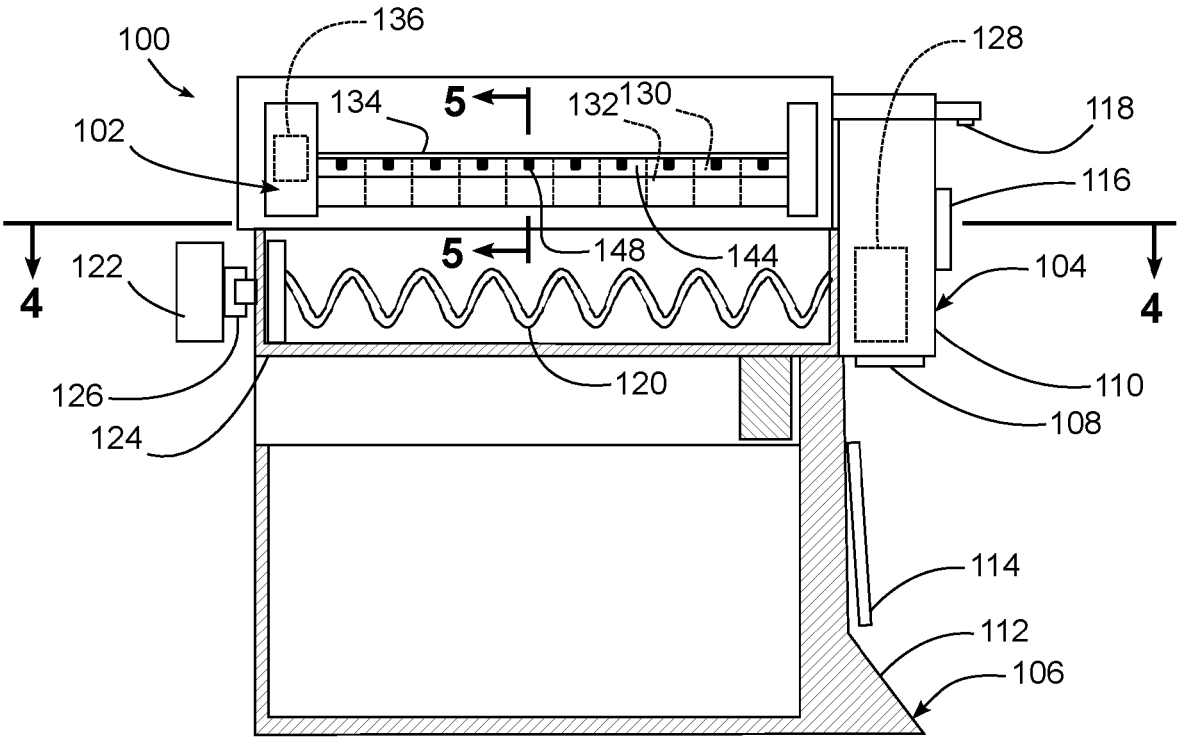
FIG. 3 is a side elevational view of an example implementation of an ice and water system consistent with some embodiments of the invention, with portions thereof cut away.
Figure 4:
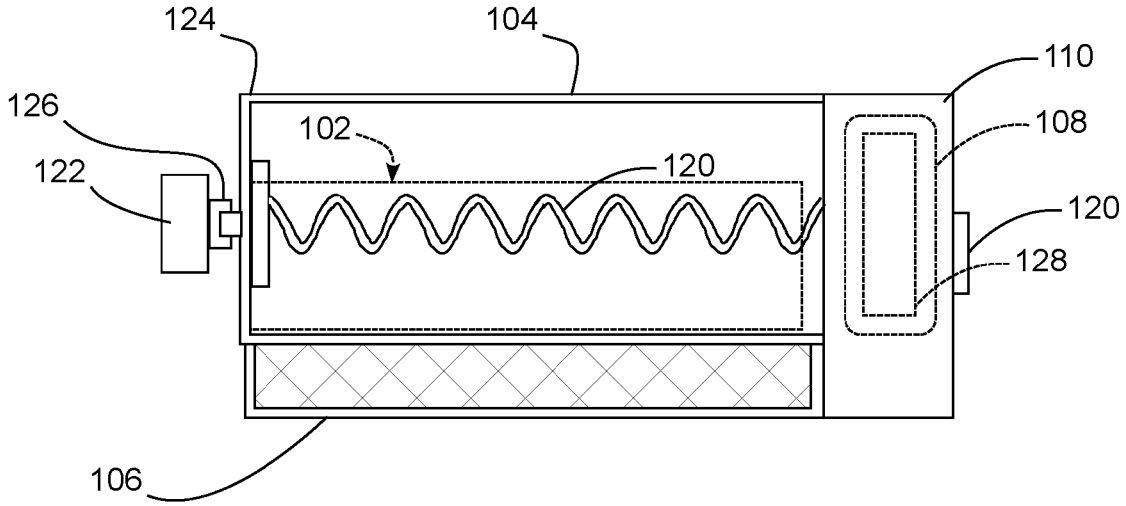
FIG. 4 is a cross-sectional view of the ice and water system of FIG. 3, taken along lines 4-4 thereof.
Figure 5:
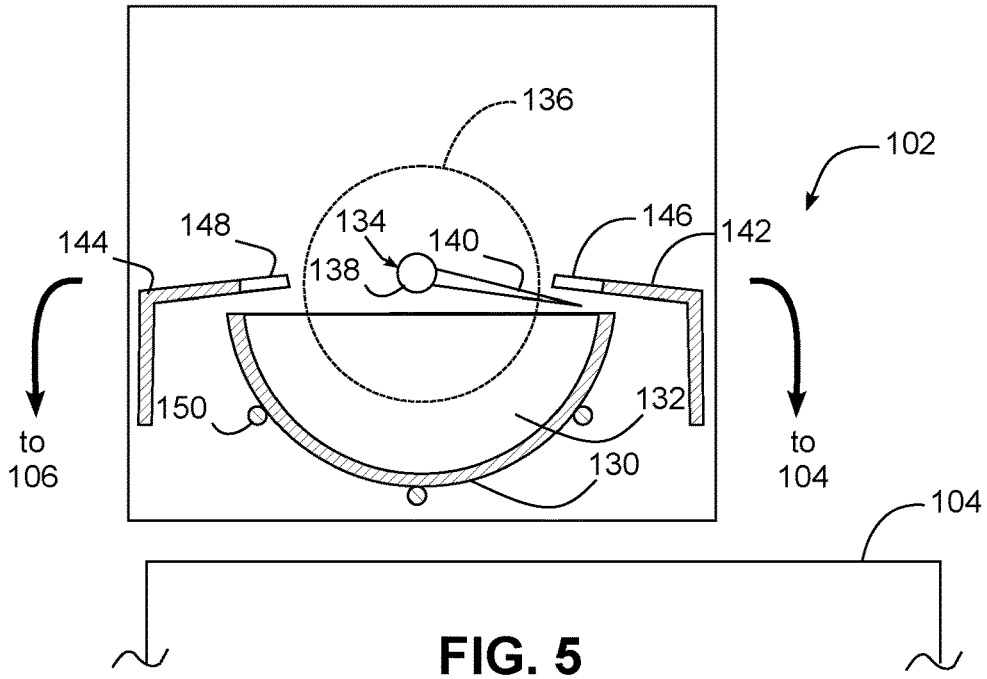
FIG. 5 is a cross-sectional view of the ice maker of the ice and water system of FIG. 3, taken along lines 5-5 thereof.

FIGS. 3-5, for example, illustrate an example implementation of an ice and water system 100 incorporating a dual direction ice maker 102 consistent with the invention, and usable, for example, to implement ice and water system 48 of refrigerator 10 illustrated in FIG. 2. System 100 includes, in addition to ice maker 102, a pair of tandem ice storage bins, referred to herein as upper and lower storage bins 104, 106 disposed below ice maker 102. In some embodiments, the ice storage and ice and water dispensing aspects of system 100 may be implemented in a similar manner to those illustrated in U.S. Publication Nos. 2019/0178556 and 2019/0178552, which are assigned to the same assignee as the present invention, and which are incorporated by reference herein. For example, with reference to FIG. 1, in some embodiments a dual direction ice maker may be incorporated into a console 32 extending upwardly from a bottom wall 34A of the fresh food compartment 14 only a portion of a height of the fresh food compartment 14 and spaced apart from each of a top wall 34B, a first side wall 34C, and a second side wall 34D, and the console may include one or more walls (e.g., wall 32A) that insulate an interior compartment 32B of the console from the fresh food compartment 14, and wherein the ice maker 102 and storage bins 104, 106 are disposed in console 32.

Each of storage bins 104, 106 is removable, e.g., via sliding outwardly from the front of a refrigerator, and upper storage bin 104 includes an ice dispenser outlet 108 disposed at a first end 110 thereof and positioned above a dispenser recess 112 defined by the front of lower storage bin 106. Ice disposed in upper storage bin 104, when moved towards first end 110, falls through ice dispenser outlet 108. Dispensing of ice may be controlled, for example, using an ice dispenser control 114, e.g., a control paddle, button or other suitable control disposed within dispenser recess 112. Water dispensing, in turn, may be controlled by a water dispenser control 116 positioned below a water outlet 118. It will be appreciated that while ice dispenser outlet 108 and water outlet 118 are disposed at different locations in ice and water system 100, in other embodiments, ice and water dispensing may be performed from generally the same location, e.g., within dispenser recess 112. In addition, while controls 114, 116 are disposed respectively on front faces of lower storage bin 106 and upper storage bin 104, in other embodiments, ice and/or water controls may be disposed on either of storage bins 104, 106 or on other structures in a refrigerator, e.g., on a fixed and non-removable surface of a cabinet or case, on a compartment door, etc. Moreover, in some embodiments, no water dispensing capability may be supported. In addition, as will become more apparent below, embodiments consistent with the invention need not employ multiple storage bins. As such, it will be appreciated that the invention is not limited to the particular ice and water system illustrated in FIG. 3.

With additional reference to FIG. 4, upper storage bin 104 also includes an ice mover, here an ice auger 120, which is implemented using a metal rod formed into a helical shape, although other ice auger designs may be used in other embodiments. Ice auger 120 is controlled via an ice mover drive 122, e.g., an electric motor, disposed proximate a second end 124 of upper storage bin 104. By virtue of the removability of upper storage bin 104, ice auger 120 is desirably mechanically coupled to ice mover drive 122 through a detachable coupling 126 (e.g., a keyed coupling that interlocks ice auger 120 with ice mover drive 122 when upper storage bin 104 is pushed rearwardly into an operative position in ice and water system 100). In embodiments where ice movers are disposed in non-removable containers, however, non-detachable couplings may be utilized.

Ice and water system 100 may also include an ice crusher assembly 128 that may be selectively activated during a dispensing operation to crush ice prior to dispensing through ice dispenser outlet 108. When cubed ice is desired, ice crusher assembly 128 may be deactivated during the dispensing operation. A wide variety of known ice crusher designs may be used in different embodiments, as will be appreciated by those of ordinary skill having the benefit of the instant disclosure.

With additional reference to FIG. 5, ice maker 102 includes a mold 130 including a plurality of mold cavities 132 suitable for producing individual ice cubes. In the illustrated embodiment, mold 130 is both upwardly-facing and stationary, such that when filled with water, the water freezes into individual ice cubes taking the shape of each individual mold cavity 132. As mold 130 is upwardly-facing and stationary, removal of ice cubes from mold 130 generally requires one or more mechanisms for ejecting the ice cubes from the mold. In the illustrated embodiment, for example, a rotatable ejector 134 may extend along a longitudinal axis of mold 130 and be driven about an axis of rotation by a motor 136. Ejector 134 may include a shaft about which the ejector rotates and a plurality of fingers 140 extending generally transverse to the shaft, with each finger 140 positioned to sweep through an individual mold cavity 132 to "push" an ice cube in the mold cavity and thereby eject the ice cube from the mold.

In some embodiments, mold 130 may include a curved bottom wall having a radius of curvature similar to the lengths of fingers 140 such that the fingers maintain a relatively constant separation from the mold surface as they sweep through the mold cavities, though the invention is not so limited. The resulting ice cubes form circular segments, although other cube shapes may be used in other embodiments. It will be appreciated that ice maker 102 also includes one or more water inlets, e.g., controlled by one or more valves, that are used to fill mold cavities 132, but which are not illustrated in FIGS. 3-5. Various manners of filling a mold with water may be used in different embodiments, as will be appreciated by those of ordinary skill having the benefit of the instant disclosure.

Ejector 134 in the illustrated embodiment is bidirectional, and as such can rotate in two opposing directions. In addition, in some embodiments, one or more position sensors may be used to determine the rotational position of the ejector, e.g., using a stepper motor for motor 136, an encoder, or by using one or more sensors capable of detecting predetermined positions about the rotational axis (e.g., using mechanical switches, magnets/hall effect sensors, optical sensors, etc.), or other position sensor designs that will be appreciated by those of ordinary skill having the benefit of the instant disclosure. The rotational position of ejector 134 may also be controlled in some embodiments at least in part based upon driving motor 136 for a predetermined time based upon a known rate of rotation. In some embodiments, ejector 134 may only rotate in a single direction.

Ice maker 102 also includes a pair of drying surfaces 142, 144 that extend along each side of mold 130. In some embodiments, drying surfaces 142, 144 may include slots 146, 148 formed therein to permit fingers 140 to pass through the drying surfaces when the ejector is rotated to a rotational position in which the fingers 140 extend above the drying surfaces. A heater 150 may also be provided on mold 130 to heat at least a portion thereof to assist in separating or releasing the ice cubes from the mold.

As will be discussed in greater detail below, each drying surface 142, 144 is configured to temporarily support an ice cube prior to the ice cube being dropped into a storage bin. In some embodiments, the drying surfaces are used to support ice cubes long enough to enable any water on the surfaces of the ice cubes (e.g., resulting from heating of the ice cubes by heater 150) to refreeze to inhibit clumping of ice cubes in the storage bins. In other embodiments, however, the drying surfaces are used to support ice cubes that have only been partially-frozen in the mold long enough to completely freeze, or at least freeze to a state that is sufficiently sturdy to withstand falling into the storage bins without breaking or fracturing.

It will be appreciated that drying surfaces 142, 144 may take a wide variety of forms in different embodiments, and may include one or more flat, planar, curved, and/or sloped surfaces that are solid or perforated, or alternatively, may include rack-like structures such as arrays of wires, bars, etc. capable of supporting an ice cube in a similar manner to a solid surface. Drying surfaces 142, 144 may be formed of plastics, metals, or other materials, and may have varying degrees of friction and/or incline to control the ease or difficulty of which ice cubes are permitted to slide off the drying surfaces and into a storage bin. Drying surfaces 142, 144 may also be ribbed and/or concave in shape to increase airflow around ice cubes and thereby increase the rate of drying and/or freezing.

In the illustrated embodiment, and with reference to FIGS. 4 and 5, drying surface 142 is positioned over upper storage bin 104 such that ice cubes that drop from drying surface 142 fall into upper storage bin 104. Conversely, drying surface 144 is positioned beyond an opposite edge of upper storage bin 104 such that ice cubes that drop from drying surface 144 do not fall into upper storage bin 104, but instead fall into a gap or passageway leading to lower storage bin 106 (illustrated with cross-hatching in FIG. 4). Consequently, ice cubes conveyed to drying surface 142 may ultimately drop into upper storage bin 104 while ice cubes conveyed to drying surface 144 may ultimately drop into lower storage bin 106.

It will be appreciated that different arrangements of apertures, passageways, channels, gaps, etc. may be used to route ice cubes to the different storage bins associated with drying surfaces 142, 144 in various embodiments of the invention. Furthermore, where only a single storage bin is used, the ice cubes dropped from drying surfaces 142, 144 may both be routed to the same storage bin in some embodiments.

Now turning to FIGS. 6A-6G, these figures illustrate the operation of ice maker 102 consistent with some embodiments of the invention. As noted above, in some embodiments, ice maker 102 may be used solely to facilitate the production of ice for multiple storage bins, whereby ice cubes may be fully frozen in mold 130 prior to be ejected onto one of drying surfaces 142, 144. However, in the embodiment illustrated in FIGS. 6A-6G, ice maker 102 is used to overlap multiple ice production cycles in time to increase the overall ice production rate of ice maker 102, in part by ejecting ice cubes from mold 130 and onto one of drying surfaces 142, 144 prior to being fully frozen, such that a next ice production cycle may be started while the ice cubes are still supported on one or both of drying surfaces 142, 144.

Figure 6A:
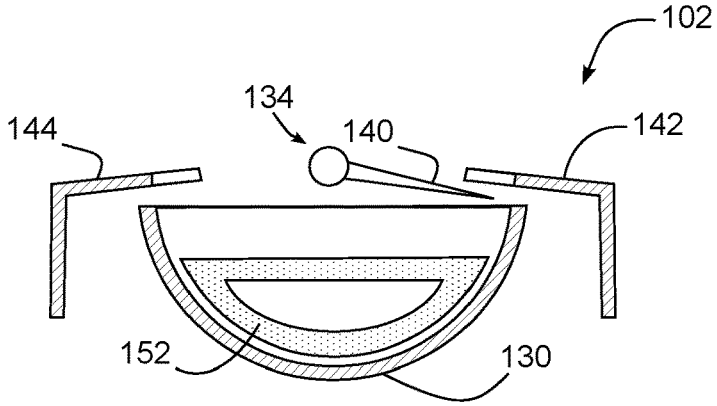
FIGS. 6A-6G are simplified views of the ice maker depicted in FIG. 5, and illustrating various operations performed during multiple ice production cycles.
Figure 6B:
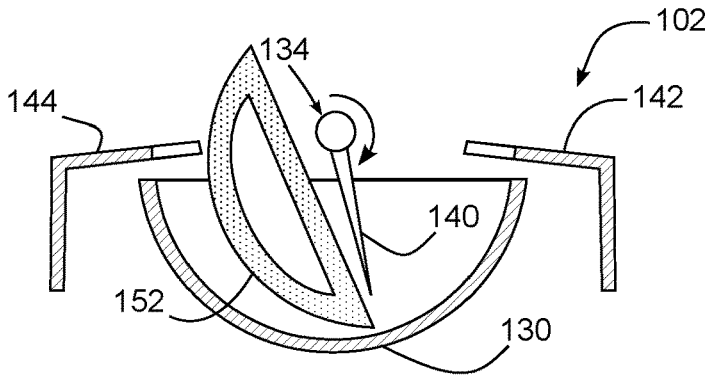

FIG. 6A, for example, illustrates a first ice cube 152 that begins to freeze in mold 130 during a first ice production cycle. When the first ice cube 152 has partially frozen to a point where a low risk exists that the first ice cube will rupture if ejected from mold 130 and dropped onto drying surface 142, heater 150 (see FIG. 5) is activated to partially melt the surface of first ice cube 152 and release the first ice cube from the mold, and as illustrated in FIG. 6B, ejector 134 is rotated in a clockwise direction such that finger 140 begins to push first ice cube 152 out of the mold.

Figure 6C:
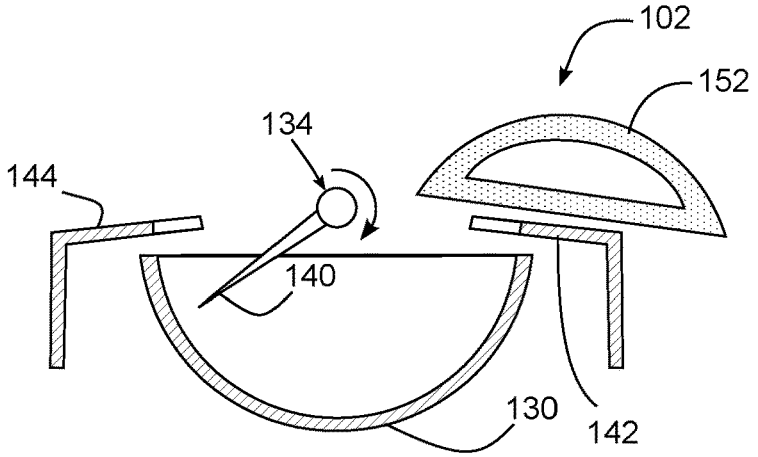

As illustrated in FIG. 6C, once ejector 134 has rotated past a pivot point, first ice cube 152 will fall over ejector 134 and onto drying surface 142. It should be noted that at this point, first ice cube 152 is still partially-frozen.

Figure 6D:
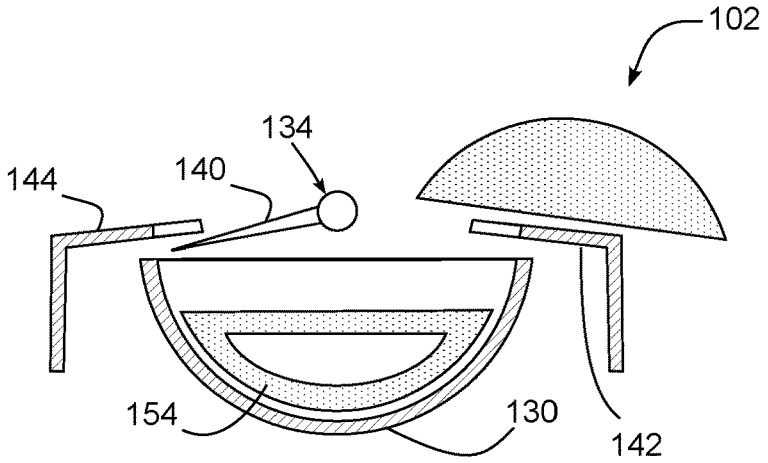

Next, as illustrated in FIG. 6D, ejector 134 may continue to rotate to the position illustrated in the figure, and then stop. A second ice production cycle may then begin, with mold 130 being refilled with water. Sometime thereafter, a second ice cube 154 forms in mold 130, while the first ice cube 152 becomes completely frozen, or at least frozen enough to withstand a drop into a storage bin.

Figure 6E:
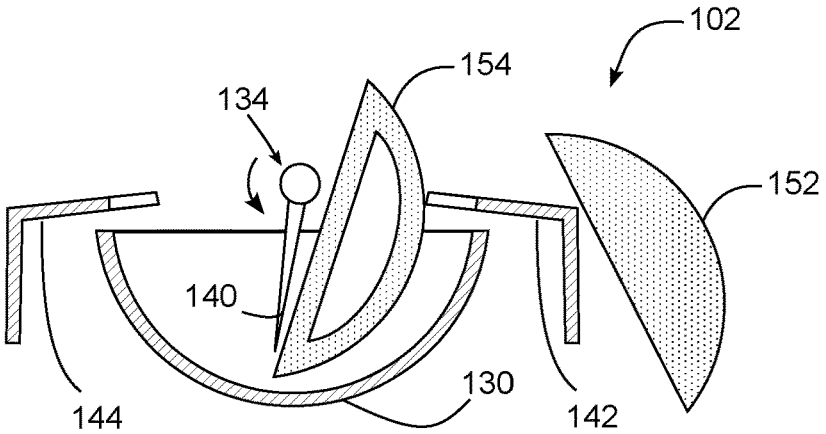

Next, as illustrated in FIG. 6E, heater 150 (see FIG. 5) is activated to partially melt the surface of second ice cube 154 and release the second ice cube from the mold, and ejector 134 is rotated in an opposite, counter-clockwise direction such that finger 140 begins to push second ice cube 154 out of the mold. Moreover, due to the fact that first ice cube 152 is in the path of second ice cube 154, second ice cube 154 will contact first ice cube 152 as it is being pushed out of mold 130, tipping first ice cube 152 off of drying surface 142 and into upper storage bin 104.

Figure 6F:
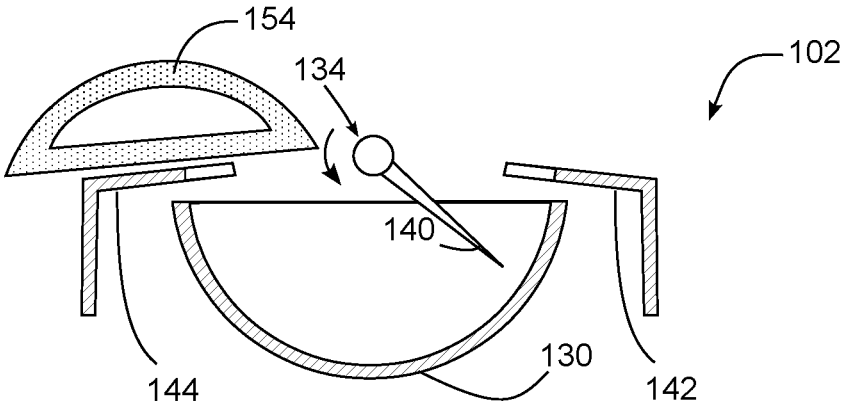
Figure 6G:
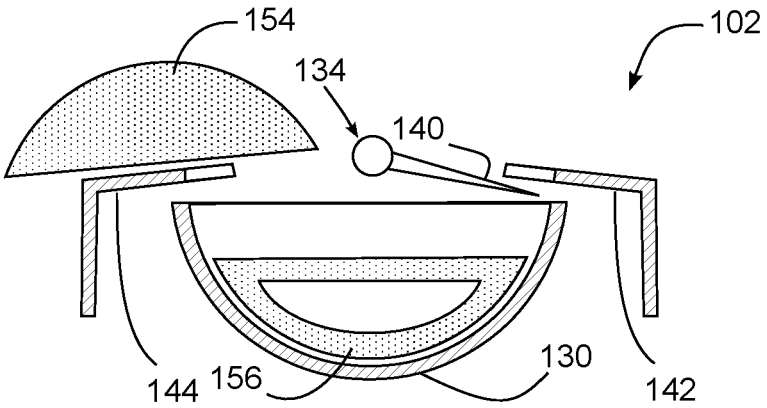

Then, as illustrated in FIG. 6F, once ejector 134 has rotated past a pivot point, second ice cube 154 will fall over ejector 134 and onto drying surface 144. It should be noted that at this point, second ice cube 154 is still partially-frozen. Thus, as illustrated in FIG. 6G, ejector 134 may continue to rotate to the position illustrated in the figure, and then stop. A third ice production cycle may then begin, with mold 130 being refilled with water. Sometime thereafter, a third ice cube 156 forms in mold 130, while the second ice cube 154 becomes completely frozen, or at least frozen enough to withstand a drop into a storage bin. The process may therefore repeat to drop second ice cube 154 off of drying surface 144 as a result of contact with third ice cube 156 when pushed via clockwise rotation of ejector 134.

As a result, it may be seen that multiple ice production cycles may be overlapped in time, with individual batches of ice cubes freezing partially in mold 130 and partially while supported by a drying surface 142, 144. Thus, by starting subsequent ice production cycles prior to completely freezing the ice cubes in earlier ice production cycles, the overall time required to produce multiple batches of ice cubes is reduced.

Figure 7A:
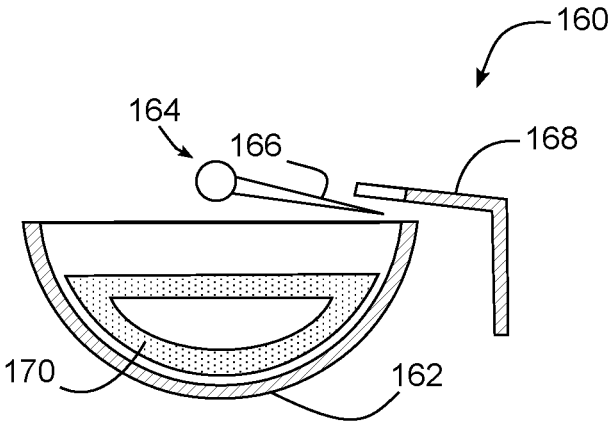
FIGS. 7A-7G are simplified views of an alternate ice maker design to that depicted in FIG. 5, and illustrating various operations performed during multiple ice production cycles.

Now turning to FIGS. 7A-7G, in some embodiments a dual direction ice maker may utilize only a single drying surface, yet may still accelerate ice production through overlapping ice production cycles in time. FIG. 7A, for example, illustrates an ice maker 160 including a mold 162, a rotatable ejector 164 including fingers 166, and a single drying surface 168 running along one side of mold 162. The figure also illustrates a first, partially-frozen ice cube 170 being produced during a first ice production cycle.

Figure 7B:
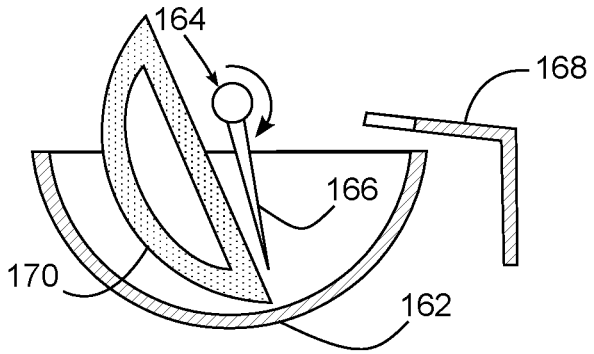
Figure 7C:
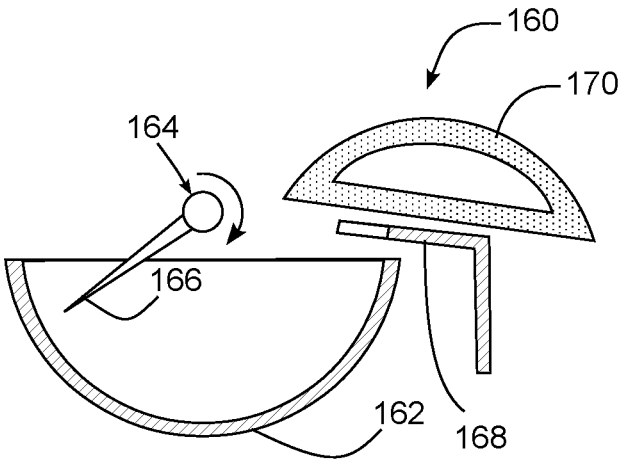

When the first ice cube 170 has partially frozen to a point where a low risk exists that the first ice cube will rupture if ejected from mold 162 and dropped onto drying surface 168, a heater may be activated to partially melt the surface of first ice cube 170 and release the first ice cube from the mold, and as illustrated in FIG. 7B, ejector 164 is rotated in a clockwise direction such that finger 166 begins to push first ice cube 170 out of the mold. Then, as illustrated in FIG. 7C, once ejector 164 has rotated past a pivot point, first ice cube 170 will fall over ejector 164 and onto drying surface 168. It should be noted that at this point, first ice cube 170 is still partially-frozen.

Figure 7D:
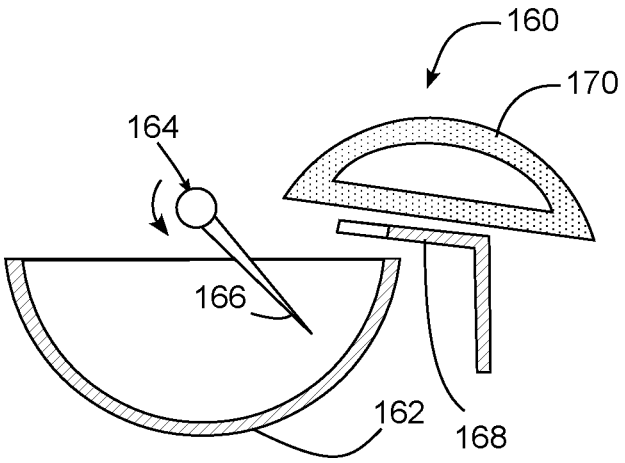

Next, as illustrated in FIG. 7D, and unlike the cycle discussed above for ice maker 102, ejector 164 may reverse and rotate in a counter-clockwise direction back to the original rotational position illustrated in FIG. 7A. A second ice production cycle may then begin, with mold 162 being refilled with water. While in this embodiment, ejector 164 is returned to its original location prior to refiling mold 162 with water, it will be appreciated that in other embodiments, ejector 164 may be returned to its original location after refilling mold 162 (but before a new ice cube has been partially formed), with fingers 166 simply passing through the unfrozen water in the mold.

Figure 7E:
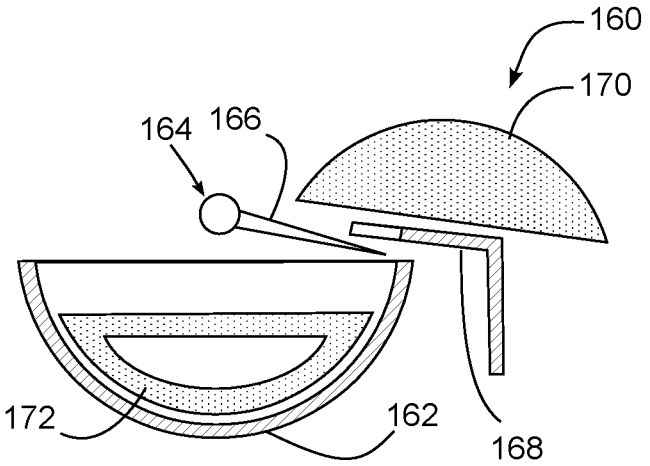
Figure 7F:
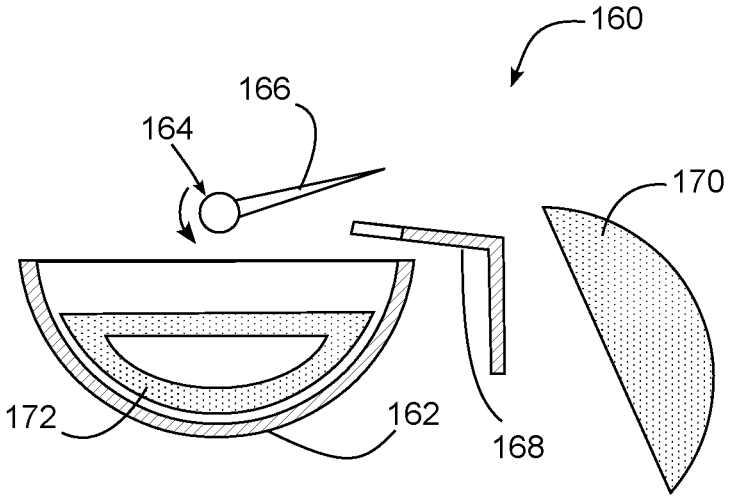
Figure 7G:
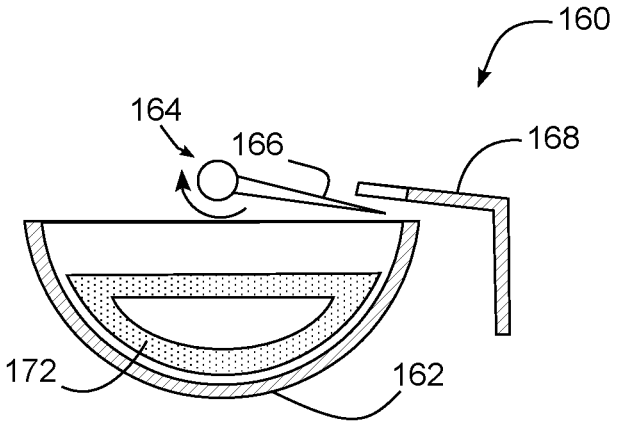

Next, as illustrated in FIG. 7E, sometime thereafter a second ice cube 172 forms in mold 162, while the first ice cube 170 becomes completely frozen, or at least frozen enough to withstand a drop into a storage bin. Then, as illustrated in FIG. 7F, ejector 164 is rotated in a counter-clockwise direction for a relatively short amount of rotation such that finger 166 tips first ice cube 170 off of drying surface 168 and drops the first ice cube into a storage bin. At this point, and as illustrated in FIG. 7G, ice maker 160 is in the same configuration as is illustrated in 7A, whereby the sequence illustrated in FIGS. 7B-7F may be repeated to push second ice cube 172 onto drying surface 168 and start a third ice production operation if desired.

As a result, it may be seen that multiple ice production cycles may again be overlapped in time, with individual batches of ice cubes freezing partially in mold 162 and partially while supported by drying surface 168. Thus, by starting subsequent ice production cycles prior to completely freezing the ice cubes in earlier ice production cycles, the overall time required to produce multiple batches of ice cubes is reduced.

Now turning to FIGS. 8A-8H, it may be desirable to utilize structures referred to herein as cube diverting surfaces to divert ice cubes being ejected by an ejector onto a drying surface prior to the ice cubes being essentially "flipped" over the top of the ejector, as is the case with ice makers 102 and 160.

Figure 8A:
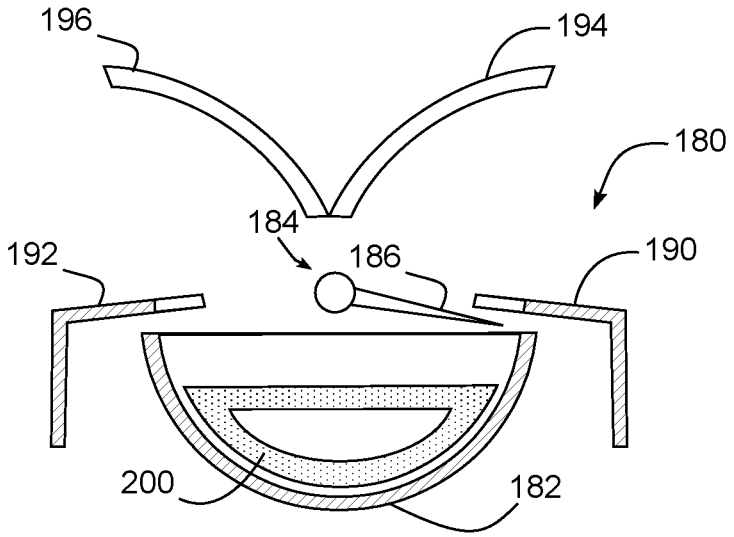
FIGS. 8A-8H are simplified views of another alternate ice maker design to that depicted in FIG. 5, and illustrating various operations performed during multiple ice production cycles.

FIG. 8A, for example, illustrates an ice maker 180 including a mold 182, a rotatable ejector 184 including fingers 186, and a pair of drying surfaces 190, 192 running along each side of mold 182 (a single drying surface may also be used in other embodiments). In addition, a pair of cube diverting surfaces 194, 196 are positioned generally above the axis of rotation of ejector 184 and intermediate drying surfaces 190, 192, and that are configured to divert ice cubes formed in mold 182 toward drying surfaces 190, 192 when the ice cubes are being ejected by ejector 184. The figure also illustrates a first, partially-frozen ice cube 200 being produced during a first ice production cycle.

Figure 8B:
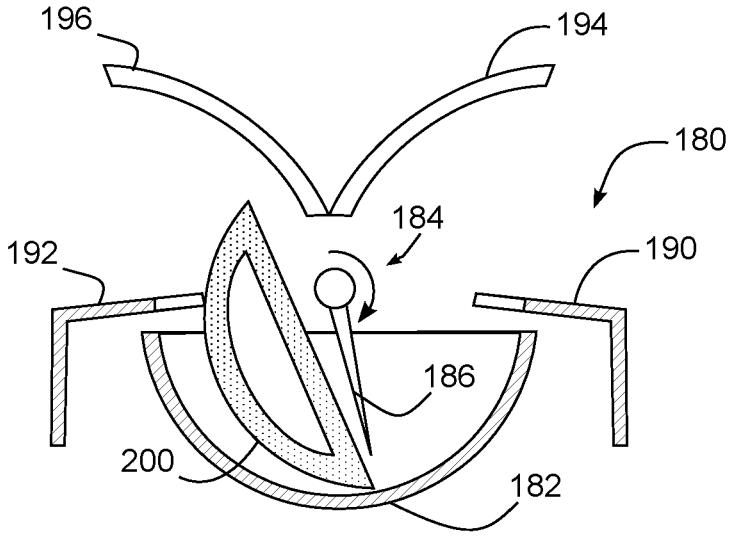
Figure 8C:
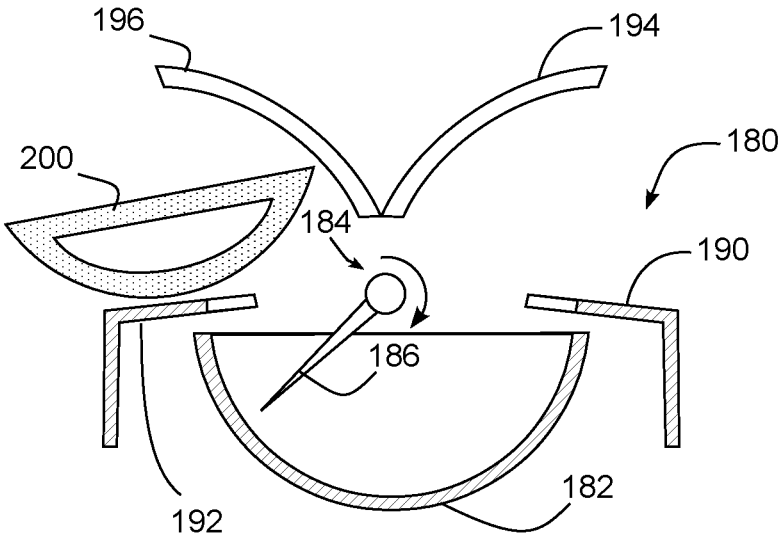

When the first ice cube 200 has partially frozen to a point where a low risk exists that the first ice cube will rupture if ejected from mold 182 and dropped onto drying surface 192, a heater may be activated to partially melt the surface of first ice cube 200 and release the first ice cube from the mold, and as illustrated in FIG. 8B, ejector 184 is rotated in a clockwise direction such that finger 186 begins to push first ice cube 200 out of the mold. Then, as illustrated in FIG. 8C, once ejector 184 has rotated past a predetermined point, first ice cube 200 will be diverted by cube diverting surface 196 and onto drying surface 192. It should be noted that at this point, first ice cube 200 is still partially-frozen.

Figure 8D:
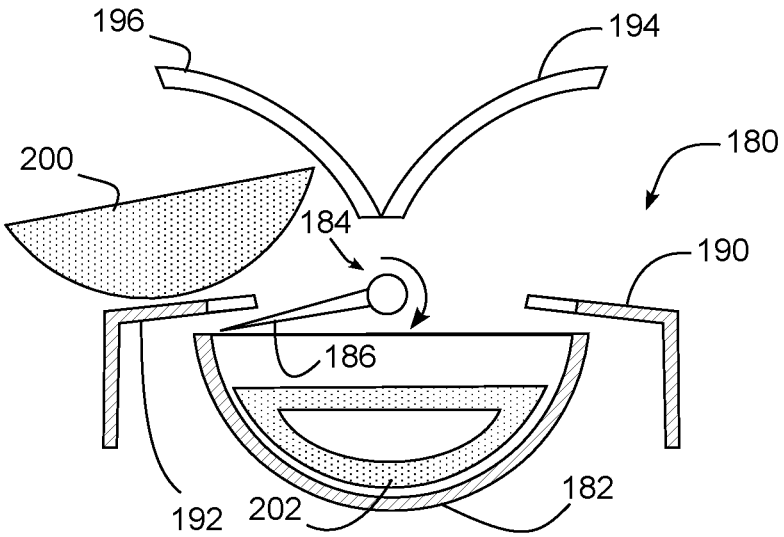
Figure 8E:
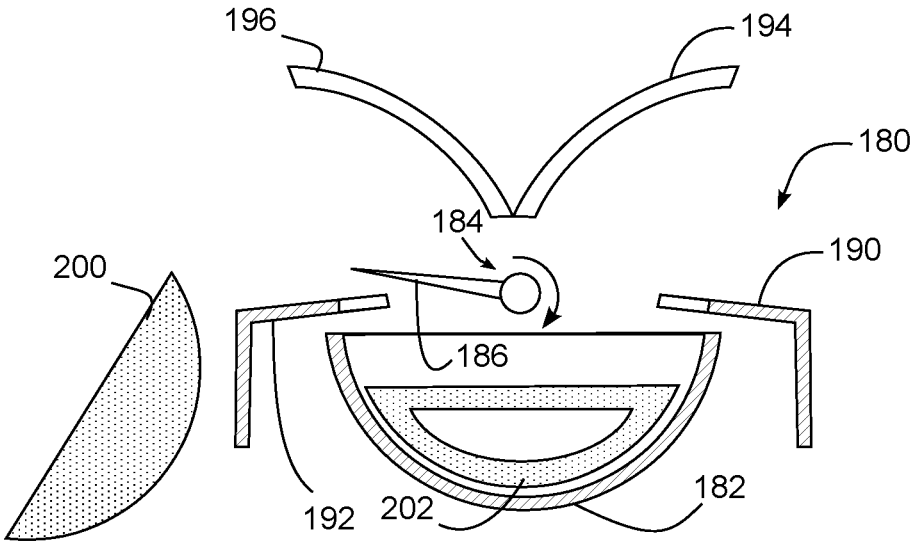

Next, as illustrated in FIG. 8D, ejector 184 may continue to rotate to the position illustrated in the figure, and then stop. A second ice production cycle may then begin, with mold 182 being refilled with water. Sometime thereafter a second ice cube 202 forms in mold 182, while the first ice cube 200 becomes completely frozen, or at least frozen enough to withstand a drop into a storage bin. Then, as illustrated in FIG. 8E, ejector 184 is rotated in a clockwise direction for a relatively short amount of rotation such that finger 186 tips first ice cube 200 off of drying surface 192 and drops the first ice cube into a storage bin.

Figure 8F:
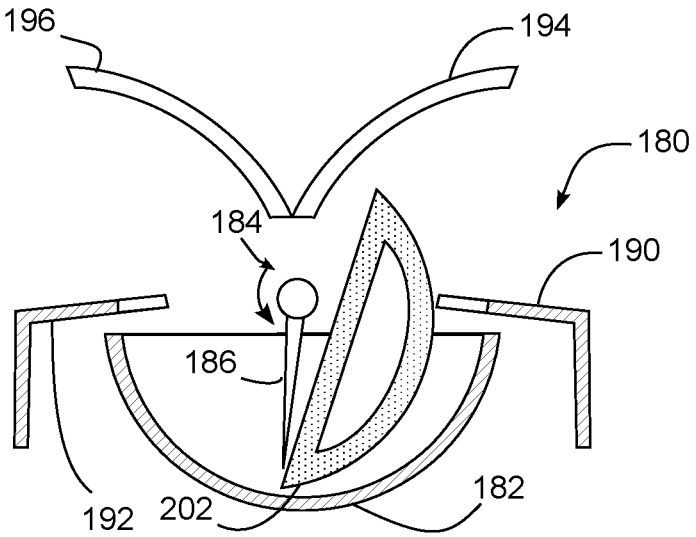
Figure 8G:
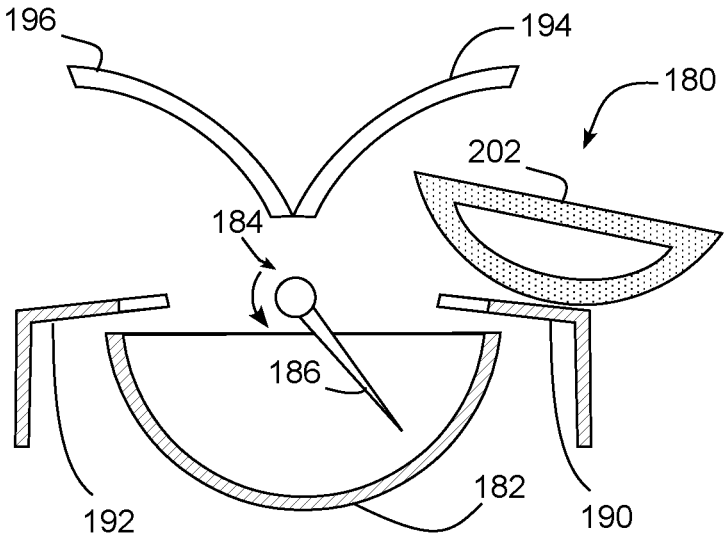
Figure 8H:
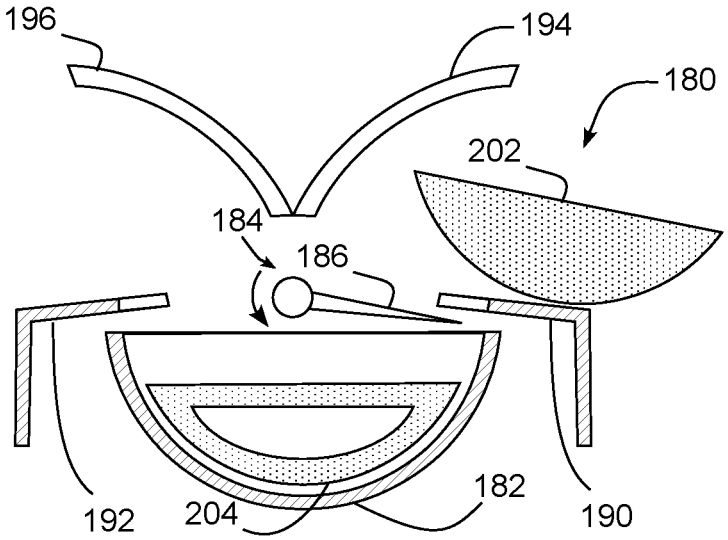

Next, as illustrated in FIG. 8F, heater 150 (see FIG. 5) is activated to partially melt the surface of second ice cube 202 and release the second ice cube from the mold, and ejector 184 is rotated in an opposite, counter-clockwise direction such that finger 186 begins to push second ice cube 202 out of the mold. Then, as illustrated in FIG. 8G, once ejector 184 has rotated past a predetermined point, second ice cube 202 will be diverted by cube diverting surface 194 and onto drying surface 190. It should be noted that at this point, second ice cube 202 is still partially-frozen. A third ice production cycle may then begin, with mold 182 being refilled with water. Sometime thereafter, and as illustrated in FIG. 8H, a third ice cube 204 forms in mold 182, while the second ice cube 202 becomes completely frozen, or at least frozen enough to withstand a drop into a storage bin. The process may therefore repeat to drop second ice cube 202 off of drying surface 190 as a result of counter-clockwise rotation of ejector 184, followed by later ejection of third ice cube 204 onto drying surface 192 as a result of clockwise rotation of ejector 184.

As a result, it may be seen that multiple ice production cycles may again be overlapped in time, with individual batches of ice cubes freezing partially in mold 182 and partially while supported by a drying surface 190, 192. Thus, by starting subsequent ice production cycles prior to completely freezing the ice cubes in earlier ice production cycles, the overall time required to produce multiple batches of ice cubes is reduced.

It will be appreciated that various geometries of cube diverting surfaces may be used in other embodiments, including different curvatures, different lengths, different positioning etc. The invention is therefore not limited to the particular configuration illustrated in FIGS. 8A-8H.

It should also be appreciated that the various embodiments discussed herein provide a number of unique features that facilitate the overlapping of ice production cycles and/or the simplification of routing of ice to multiple storage bins disposed in a refrigerator. For example, in some embodiments, an ejector may be capable of ejecting ice cubes onto either of multiple drying surfaces disposed along opposite sides of a mold. In addition, in some embodiments, an ejector may be capable of pushing ice cubes formed in a mold and ejected onto a drying surface off of that drying surface after the mold is refilled with water. Furthermore, in some embodiments, an ejector may be capable of push one set of ice cubes formed in a mold and ejected onto a drying surface off of that drying surface by pushing a second set of ice cubes subsequently formed in the mold such that the second set of ice cubes effectively contact and push the first set of ice cubes off of the drying surface. Moreover, in some embodiments, an ejector may be bidirectional to enable ice cubes to be ejected into different storage bins based upon the direction of rotation of the ejector.

Moreover, in various embodiments incorporating multiple drying surfaces and multiple storage bins, it will be appreciated that the sequence of operations performed in an ice production cycle may be varied, e.g., to route multiple batches of ice cubes to a particular storage bin, rather than alternating between different storage bins.

Other variations will be apparent to those of ordinary skill having the benefit of the instant disclosure. For example, other mechanisms for ejecting ice from a mold may be used, and various techniques disclosed herein may be used in connection with other types of molds, e.g., molds that are rotatable and/or twistable to eject ice therefrom. It will be appreciated that various additional modifications may be made to the embodiments discussed herein, and that a number of the concepts disclosed herein may be used in combination with one another or may be used separately. Therefore, the invention lies in the claims hereinafter appended.

What is claimed is:

1. A refrigerator ice maker, comprising:

a mold including a plurality of mold cavities;

first and second drying surfaces disposed on opposite sides of the mold; and a rotatable ejector configured to eject ice cubes formed in the plurality of mold cavities onto either of the first and second drying surfaces, wherein the rotatable ejector is configured to rotate in a first direction to eject a first set of ice cubes formed in the plurality of mold cavities onto the first drying surface while the first set of ice cubes are only partially frozen, and wherein the refrigerator ice maker is configured to cause the mold to be filled with water prior to full freezing of the first set of ice cubes to initiate formation of a second set of ice cubes in the mold while the first set of ice cubes are disposed on the first drying surface.

2. The refrigerator ice maker of claim 1, wherein the mold is upwardly-facing and stationary.

3. The refrigerator ice maker of claim 1, wherein the rotatable ejector includes a plurality of fingers configured to sweep through the plurality of mold cavities, and wherein at least one of the first and second drying surfaces includes a plurality of slots configured to allow passage of the plurality of fingers through the at least one of the first and second drying surfaces.

4. The refrigerator ice maker of claim 1, wherein the rotatable ejector is bidirectional and is configured to rotate in a first direction to eject ice cubes onto the first drying surface and rotate in a second direction to eject ice cubes onto the second drying surface.

5. The refrigerator ice maker of claim 1, wherein the rotatable ejector is configured to rotate and push the first set of ice cubes off of the first drying surface after the mold is filled with water.

6. The refrigerator ice maker of claim 5, wherein the rotatable ejector is configured to rotate and push the first set of ice cubes off of the first drying surface by rotating in a second direction that pushes ice cubes from the second set of ice cubes into contact with ice cubes from the first set of ice cubes.

7. The refrigerator ice maker of claim 6, wherein the rotatable ejector is configured to rotate in the second direction after the first set of ice cubes are pushed off the first drying surface to eject the second set of ice cubes onto the second drying surface.

8. The refrigerator ice maker of claim 1, further comprising first and second cube diverting surfaces positioned substantially above an axis of rotation of the rotatable ejector and intermediate the first and second drying surfaces and respectively configured to divert ice cubes formed in the plurality of mold cavities toward the first and second drying surfaces.

9. The refrigerator ice maker of claim 1, wherein first and second storage receptacles are respectively positioned below the first and second drying surfaces such that ice cubes pushed from the first and second drying surfaces respectively drop into the first and second storage receptacles.

10. The refrigerator ice maker of claim 1, further comprising a heater coupled to the mold and configured to heat the mold to release the ice cubes in connection with ejecting the ice cubes with the rotatable ejector.

11. A refrigerator ice maker, comprising:
a mold including a plurality of mold cavities;
a drying surface disposed adjacent the mold; and
a rotatable ejector configured to eject ice cubes formed in the plurality of mold cavities onto the drying surface, the rotatable ejector further configured to push the ice cubes from the drying surface after the mold is filled with water.

12. The refrigerator ice maker of claim 11, wherein the rotatable ejector is bidirectional and is configured to rotate in a first direction to eject the ice cubes onto the drying surface and rotate in a second direction to the push the ice cubes from the drying surface after the mold is filled with water.

13. The refrigerator ice maker of claim 11, wherein the ice cubes comprise a first set of ice cubes, wherein the rotatable ejector is configured to rotate in a first direction to eject the first set of ice cubes formed in the plurality of mold cavities onto the drying surface while the first set of ice cubes are only partially frozen, and wherein the refrigerator ice maker is configured to cause the mold to be filled with water prior to full freezing of the first set of ice cubes to initiate formation of a second set of ice cubes in the mold while the first set of ice cubes are disposed on the drying surface.

14. The refrigerator ice maker of claim 13, wherein the rotatable ejector is configured to rotate and push the first set of ice cubes off of the first drying surface by rotating in a second direction that pushes ice cubes from the second set of ice cubes into contact with ice cubes from the first set of ice cubes.

15. The refrigerator ice maker of claim 14, wherein the drying surface is a first drying surface, wherein the refrigerator ice maker further comprises a second drying surface extending along an opposite side of the mold from the first drying surface, and wherein the rotatable ejector is configured to rotate in the second direction after the first set of ice cubes are pushed off the first drying surface to eject the second set of ice cubes onto the second drying surface.

16. The refrigerator ice maker of claim 11, wherein first and second storage receptacles are respectively positioned below the first and second drying surfaces such that ice cubes pushed from the first and second drying surfaces respectively drop into the first and second storage receptacles.

17. The refrigerator ice maker of claim 11, further comprising a cube diverting surface positioned substantially generally above an axis of rotation of the rotatable ejector and configured to divert ice cubes formed in the plurality of mold cavities toward the drying surface.

18. The refrigerator ice maker of claim 17, wherein the cube diverting surface is a first cube diverting surface and the drying surface is a first drying surface, and wherein the refrigerator ice maker further comprises:
a second drying surface extending along an opposite side of the mold from the first drying surface; and
a second cube diverting surface positioned substantially above the axis of rotation of the rotatable ejector and configured to divert ice cubes formed in the plurality of mold cavities toward the second drying surface.

19. A refrigerator ice maker, comprising:
a mold including a plurality of mold cavities;
a drying surface disposed adjacent the mold; and
a rotatable ejector configured to eject a first set of ice cubes formed in the plurality of mold cavities onto the drying surface, the rotatable ejector further configured to push the first set of ice cubes from the drying surface by ejecting a second set of ice cubes subsequently formed in the plurality of mold cavities such that the second set of ice cubes pushes the first set of ice cubes from the drying surface.

20. A refrigerator, comprising:
a cabinet including one or more food compartments and one or more doors closing the one or more food compartments; and
an ice system disposed in the cabinet, the ice system comprising:
an ice maker including a mold including a plurality of mold cavities and a rotatable ejector configured to eject ice cubes formed in the plurality of mold cavities;
first and second storage receptacles respectively disposed below first and second sides of the mold; and
a first drying surface disposed on the first side of the mold;
wherein the rotatable ejector of the ice maker is configured to rotate in a first direction to eject the ice cubes for dispensing into the first storage receptacle and to rotate in a second direction to eject the ice cubes for dispensing into the second storage receptacle, wherein the rotatable ejector is further configured to rotate in the first direction to eject a first set of ice cubes formed in the plurality of mold cavities onto the first drying surface while the first set of ice cubes are only partially frozen, and wherein the ice system is configured to cause the mold to be filled with water prior to full freezing of the first set of ice cubes to initiate formation of a second set of ice cubes in the mold while the first set of ice cubes are disposed on the first drying surface.

21. The refrigerator of claim 20, wherein the one or more food compartments includes a freezer compartment and a fresh food compartment disposed in the cabinet above the freezer compartment and having a top wall, a bottom wall, and first and second side walls, the bottom wall separating the fresh food compartment from the freezer compartment, wherein the refrigerator further comprises a console extending upwardly from the bottom wall of the fresh food compartment and only a portion of a height of the fresh food compartment and spaced apart from each of the top wall, the first side wall, and the second side wall, the console including one or more walls that insulate an interior compartment of the console from the fresh food compartment, and wherein the ice maker and the first storage receptacle are disposed in the console.

22. A method of making ice, the method comprising:
forming an ice cube in a mold of a refrigerator ice maker;
ejecting the ice cube from the mold and onto a drying surface of the refrigerator ice maker;
filling the mold with water after ejecting the ice cube; and
pushing the ice cube off of the drying surface after filling the mold with water.

* * * * *